US005884847A

United States Patent [19]

Christopher

[11] Patent Number: 5,884,847

[45] Date of Patent: Mar. 23, 1999

[54] MULTIPLE NOZZLE SPRAY HEAD APPARATUS

[76] Inventor: Gilman O. Christopher, 924 W. 11th Pl., Mesa, Ariz. 85201

[21] Appl. No.: 71,257

[22] Filed: May 1, 1998

[51] Int. Cl.[6] ..... A62C 31/02; B05B 1/12

[52] U.S. Cl. ..... 239/390; 239/392; 239/394; 239/437; 239/451; 239/550

[58] Field of Search ..... 239/390, 391, 239/392, 394, 436, 437, 451, 538, 540, 548, 550

[56] References Cited

U.S. PATENT DOCUMENTS

| | | | |
|---|---|---|---|
| 2,388,093 | 10/1945 | Smith | 239/394 |
| 3,516,611 | 6/1970 | Piggott | 239/391 |
| 3,596,835 | 8/1971 | Smith et al. | 239/394 |
| 3,704,831 | 12/1972 | Clark | 239/394 |
| 3,711,029 | 1/1973 | Bartlett | 239/394 |
| 4,221,334 | 9/1980 | Christopher | 239/394 |
| 4,347,981 | 9/1982 | Hayes | 239/394 |
| 4,461,426 | 7/1984 | Christopher | 239/394 |
| 4,666,085 | 5/1987 | Liaw | 239/394 |

*Primary Examiner*—Gregory L. Huson
*Assistant Examiner*—Robin O. Evans
*Attorney, Agent, or Firm*—H. Gordon Shields

[57] ABSTRACT

Multiple nozzle spray head apparatus includes a base element and a nozzle selector plate rotatably secured to the base element. Different nozzle tips may be secured to the nozzle selector plate for delivering different quantities of spray. The nozzle selector plate includes a blank portion which represents or defines an off position for the apparatus. The nozzle selector plate may be rotated as desired to align a delivery port on the base element with a desired nozzle tip. Different embodiments of nozzle selector plates are disclosed. The base element may be secured to a quick disconnect unit for ease of replacement. The base element may include a groove which matingly engages locking elements on the quick disconnect unit, if desired.

17 Claims, 6 Drawing Sheets

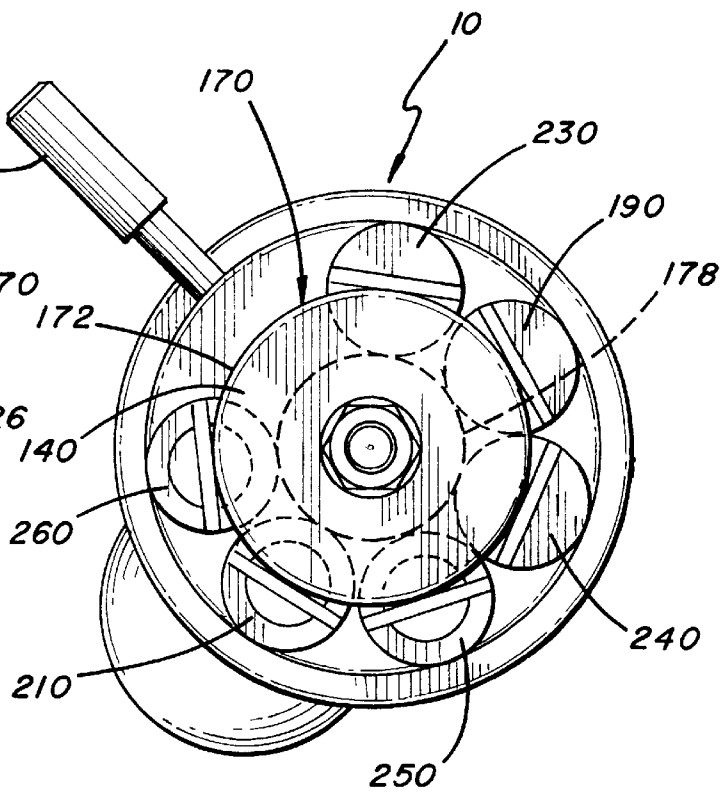
FIG. 2
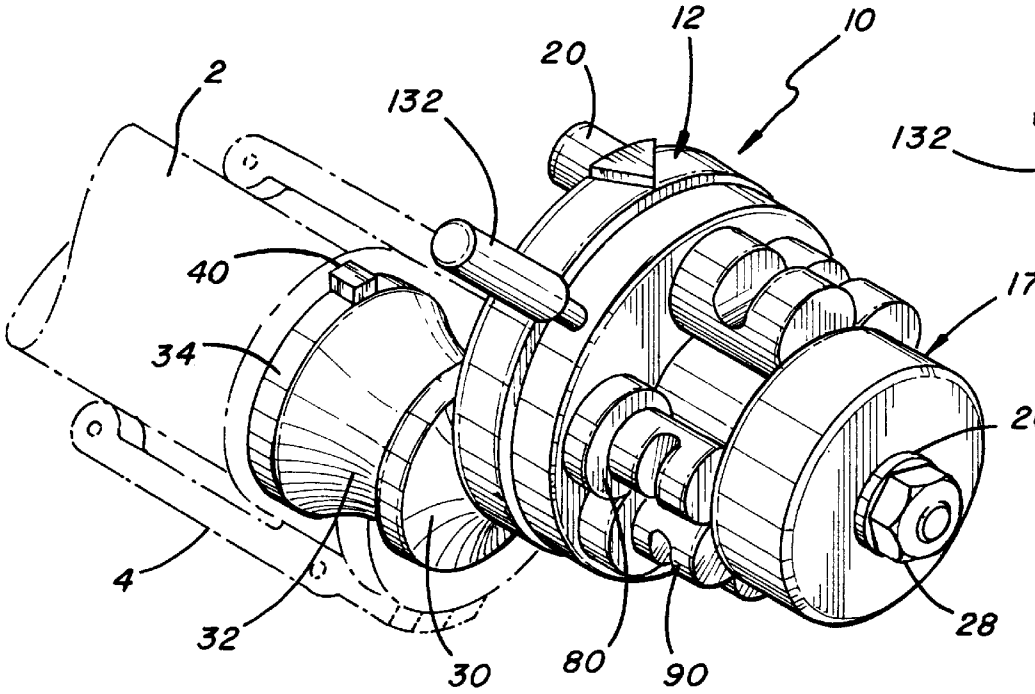
FIG.

MULTIPLE NOZZLE SPRAY HEAD APPARATUS

BACKGROUND OF THE INVENTION

1. Field of the Invention

This invention relates to spray heads and, more particularly, to a spray head having a multiple nozzles selectively alignable with an orifice for delivering a spray.

2. Description of the Prior Art

U.S. Pat. No. 4,221,334 discloses a nozzle apparatus which includes a rotatable head having a plurality of nozzle heads extending through the head, and each nozzle port is aligned with a curved surface. The holes differ in size to provide a varying quantity, as desired. The head is rotatable so that a desired hole may be aligned with a delivery port through which liquid flows to be sprayed.

U.S. Pat. No. 4,461,426, the inventor of which is also the inventor hereof, discloses another type of adjustable aerial spray nozzle apparatus. The '426 patent discloses a nozzle apparatus with two nozzle elements which are mutually selectable. One rotatable element includes a plurality of holes that may be aligned with the liquid delivery port. The second rotatable element includes three different spray faces against which the liquid impinges to provide a particular desired spray.

In the '334 patent, the curved face adjacent to each spray delivery hole provides substantially the same type of spray, and accordingly only the quantity varies. In the '426 apparatus, both the quantity of the liquid is varied and also the spray faces are varied. However, only three different spray faces are provided. Thus, any of three different spray quantity holes may be aligned with any of the three spray faces.

The apparatus of the present invention provides a single rotatable element, but the single rotatable element includes six different ports or bores to which fixed nozzle tips may be secured. The nozzle tips may vary in both or either quantity and spray face, as desired. Thus, a crop duster may select a particular nozzle tip that will be applicable for a particular spray job by merely pivoting or rotating a single disk to align the desired nozzle tip with the delivery port

SUMMARY OF THE INVENTION

The invention described and claimed herein comprises a spray head having a movable plate with a plurality of bores on the plate for receiving nozzle tips. The nozzle tips may provide the same or different spray patterns, and also different quantities. The movable plate, or selector plate, has the same orifice or hole size for each nozzle tip. The tips accordingly determine the quantity variation. The rotatable plate is secured to a base, and the base may include a quick change type coupling to enable the spray head to be quickly and easily removed from and secured to a delivery element. The delivery element is, of course, fixed to the aircraft to which the apparatus may be secured or to any appropriate source of fluid if the apparatus is used on other than an aircraft. For convenience, the apparatus will be discussed herein as if it were for a crop dusting aircraft, but it will be understood that the apparatus may be used with any type of spraying equipment.

Among the objects of the present invention are the following:

To provide new and useful spray apparatus;

To provide new and useful spray apparatus having a rotatable plate to which is secured a plurality of nozzle tips;

To provide new and useful spray apparatus having a rotatable plate secured to a quick change base;

To provide new and useful spray head apparatus which may be easily and quickly removed from and secured to a liquid delivery port; and To provide new and useful spray apparatus for providing a plurality of nozzle tips which may be easily secured to and removed from a rotatable plate on a spray head.

BRIEF DESCRIPTION OF THE DRAWING

FIG. 1 comprises a perspective view of the apparatus of the present invention in its use environment.

FIG. 2 is a front view of the apparatus of FIG. 1.

DESCRIPTION OF THE PREFERRED EMBODIMENT

Figure 3:
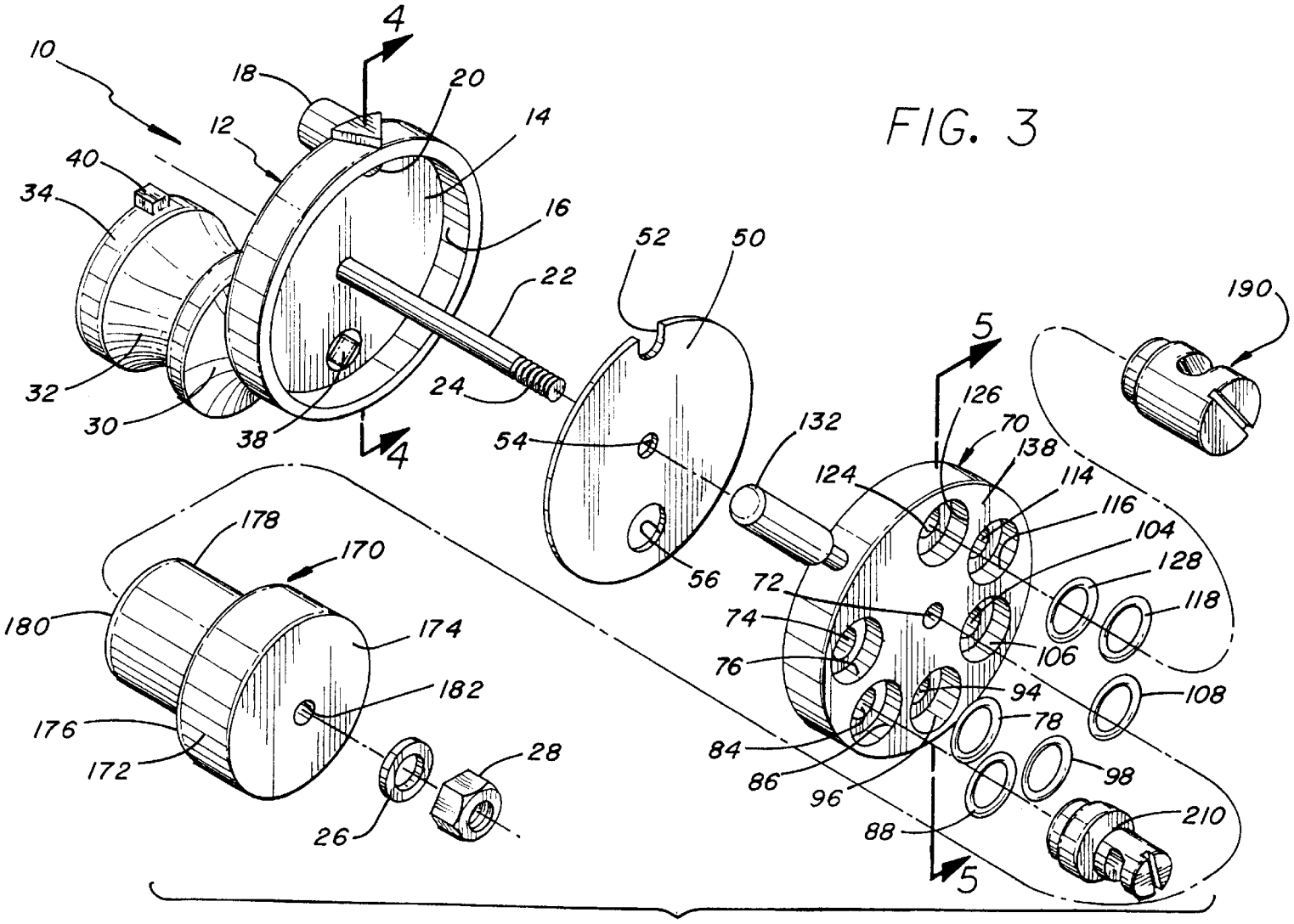
FIG. 3 is an exploded perspective view of the apparatus of the present invention.

FIG. 1 comprises a perspective view of nozzle apparatus of the present invention connected to a liquid delivery pipe 2 of a quick disconnect unit 4 shown in dash dot line. The apparatus 10 includes a base 12 and the base 12 includes a connector boss 30. The connector boss 30 is in turn secured to the quick disconnect unit 4 and its delivery pipe 2.

Figure 5:
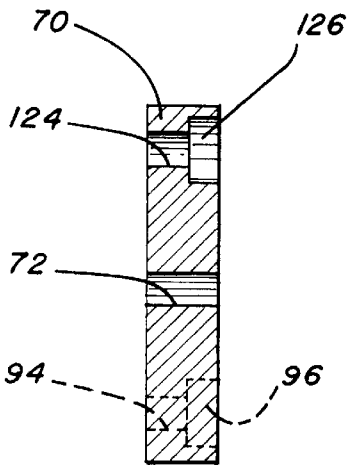
FIG. 5 is a view in partial section taken generally along line 5—5 of FIG. 3.
Figure 4:
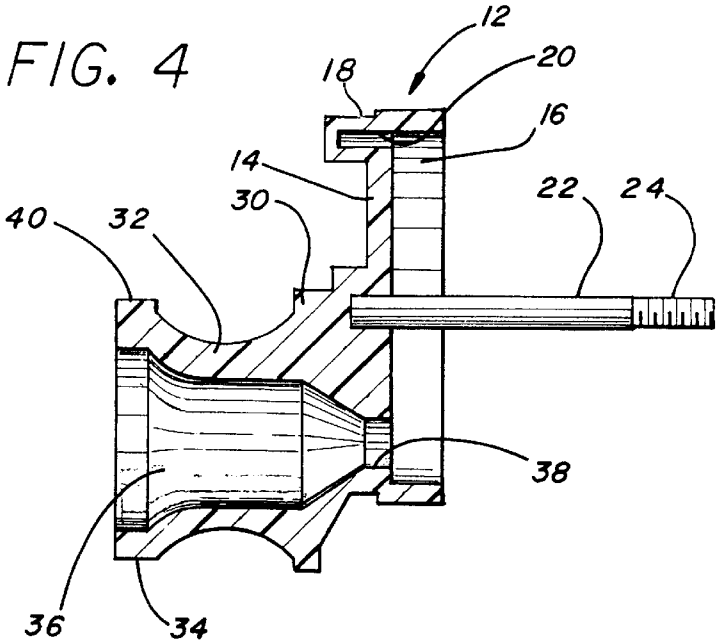
FIG. 4 is a view in partial section taken generally along line 4—4 of FIG. 3.

FIG. 2 comprises a front view of the apparatus 10, and FIG. 3 comprises an exploded perspective of the nozzle apparatus 10. FIG. 4 comprises a view in partial section taken generally through the base 12 and generally along line 4—4 of FIG. 3. FIG. 5 is a view in partial section of a portion of the apparatus 10 taken generally along line 5—5 of FIG. 3.

Figure 8:
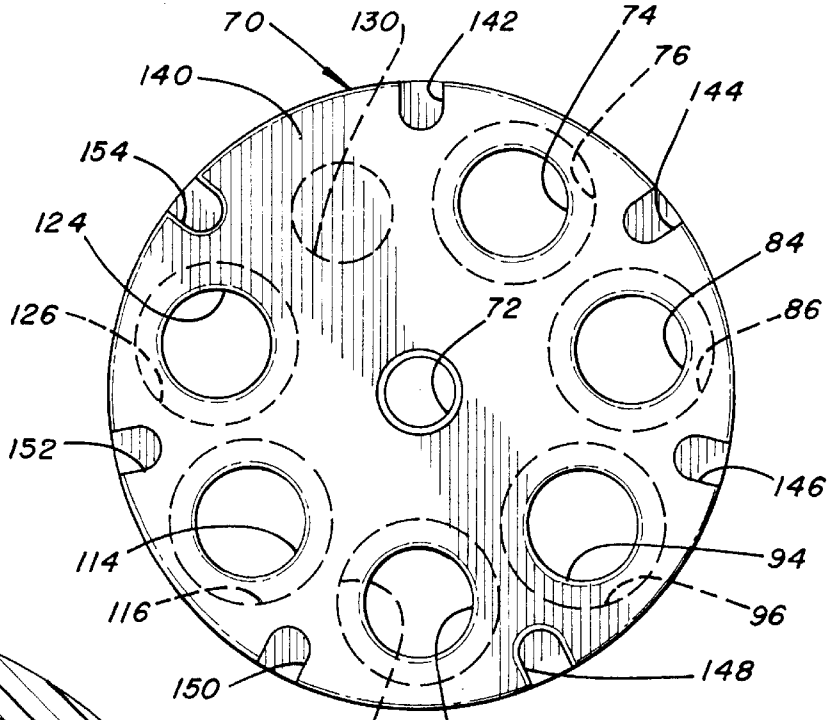
FIG. 8 is a front view of a portion of the apparatus of the present invention.
Figure 7:
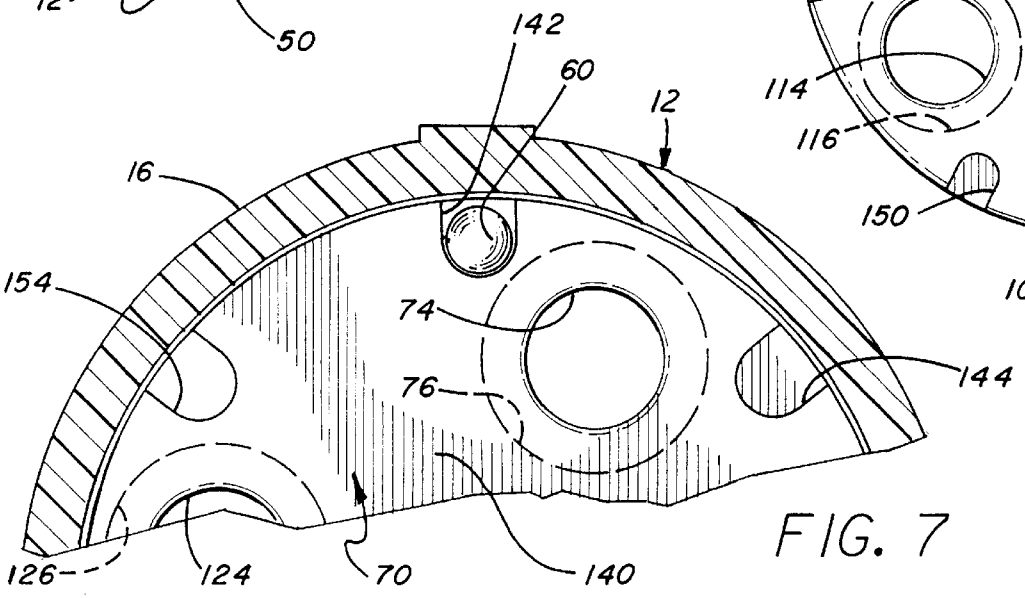
FIG. 7 is a view in partial section taken generally along line 7—7 of FIG. 6.
Figure 6:
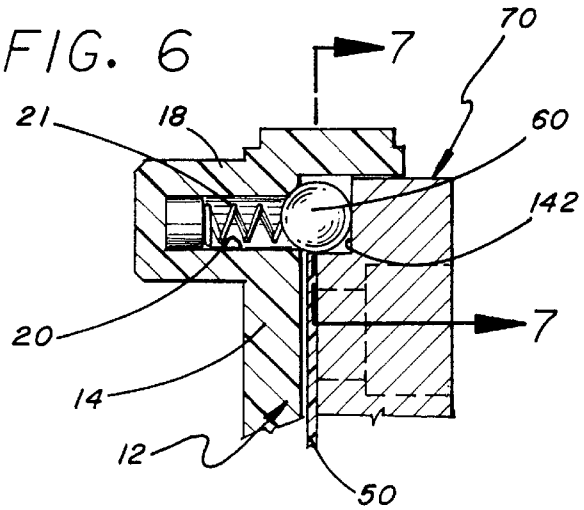
FIG. 6 is a view in partial section of another portion of the apparatus of the present invention.

FIG. 6 is a side view in partial section of a portion of the apparatus of the present invention. FIG. 7 is a view in partial section taken generally along line 7—7 of FIG. 6. FIG. 8 is a plan view of a portion of the apparatus of the present invention. For the following discussion, reference will generally be made to FIGS. 1–8.

Nozzle apparatus 10 includes a base 12 which is fixed relative to the delivery pipe 2. The base 12, best shown in FIGS. 3 and 4, includes a back wall 14 and an outwardly extending rim 16. The rim 16 is generally perpendicular to the back wall 14, and extends circumferentially about the back wall 14. At the upper portion of the base 12, adjacent to where the rim 16 extends outwardly from the back wall 14, is a boss 18. Extending into the boss 18 is a bore 20. In the bore 20 is a compression spring 21 which biases a ball 60 outwardly. The function of the ball 60 will be discussed below.

A pin or stud 22 is appropriately secured to the back wall 14, and extends axially outwardly from the back wall 14. This is shown in both FIGS. 3 and 4. The stud 22 is concentric with respect to the back wall 14 and the rim 16.

At the outer end of the pin or stud 22 is a threaded portion 24. The threaded portion 24 is remote from the back wall 14 of the base 12.

The connector boss 30 includes a concave circumferentially extending groove 32 which cooperates with a quick release assembly, discussed in detail below. The concave circumferential portion 32 extends from the back wall 14 to a connector rim 34. Extending through a connector boss 30 is a connector bore 36. The connector bore 36, best shown in FIG. 4, extends to a delivery port 38. The delivery port 38 communicates through the back wall 14.

Extending upwardly on the rim 34 is a tab 40. The tab 40 is an index tab used to align the base 12 with a mating notch 330 (see FIG. 15) on the quick disconnect assembly, discussed in detail below.

A sealing or gasket disk 50 is disposed against the back wall 14. The disk 50 includes a notch 52 extending radially inwardly from the outer periphery of the disk 50. The disk 50 also includes a center aperture 54 through which extends the pin or stud 22. Circumferentially aligned with the notch 52 is the delivery aperture 56. With the disk 50 disposed against the back wall 14, the notch 52 is aligned with the aperture 20 and the aperture 56 is aligned with the delivery poll 38.

A rotatable nozzle selector plate 70 is disposed against the disk 50 and within the rim 16 of the base 12. The nozzle selector plate 70 includes a center aperture 72 through which the stud or pin 22 extends. A pivot lever 132 extends radially outwardly from the periphery of the nozzle selector plate 70. The lever 132 is used to rotate the plate 70 to align a desired nozzle with the delivery port 38 and the base 12 and also with the delivery aperture 56 in the disk 50.

A plurality of delivery bores and counter bores extend through the nozzle selector plate 70. As shown in FIG. 3, there are six delivery bores, and the bores are spaced apart from each other about 51.4 degrees. Each delivery bore includes a counterbore which receives a nozzle tip.

There are seven positions on the plate 70, but only six delivery bores and counterbore for the nozzle tips. There is accordingly a blank or solid portion of the plate 70 which may be aligned with the bore 38 and the aperture 56 to define a cutoff position. The bores and counterbores of the plate 70 provide communication between the delivery port 38 and nozzles tips disposed in the counterboles.

As also shown in FIG. 3, there is a delivery bore 74 with its counterbore 76, and an O-ring 78 is shown spaced apart from the counterbore 76. There is also a delivery bore 84 with its counterbore 86 and its O-ring 88. There is a third delivery bore 94, with its counterbore 96 and its O-ring 98, and a fourth delivery bore 104 with its counterbore 106 and O-ring 108. There is also a delivery bore 114 with its counterbore 116 and O-ring 118, and a sixth delivery bore 124 with its counterbore 126 and O-ring 128. The O-rings help to seal nozzles in the counterbores.

With the six bores and counterbores, but a total of, essentially, seven locations on the disk 70, it will be noted that none of the counterbores are aligned diametrically with each other. Rather, there are index notches located on the back of the plate 70 aligned diametrically with the delivery bores. This is best shown in FIGS. 7 and 8. FIG. 8 comprises a plan view of the plate 70 illustrating a back face 140 of the disk 70 and showing the bores 74, 84, 94, 104, 114, and 124, the central aperture or bore 72, and a plurality of spaced apart indexing notches. The notches include a notch 142, a notch 144, a notch 146, a notch 148, a notch 150, a notch 152, and a notch 154. The notch 142 is diametrically aligned with the bore 104. The notch 144 is diametrically aligned with the bore 114. The notch 146 is diametrically aligned with the bore 124. The notch 148 is diametrically aligned with a blank portion of the disk 70. The notch 150 is diametrically aligned with the bore 74. The notch 152 is diametrically aligned with the bore 84. The notch 154 is diametrically aligned with the bore 94.

As best shown in FIGS. 6 and 7, the ball 60 is disposed at the juncture of the bore 20 of the boss 18 and at the back wall 14. The ball 60 is disposed in the notch 52 of the gasket 50. The ball 60 is shown disposed or extending into the notch 142 of the disk 70 in FIGS. 6 and 7. The respective notches are used to align the bores, and accordingly the nozzles and the counterbores, with the delivery port 38. When the notch 148 is indexed with the ball 60, the blank portion of the disk 70 is aligned with a delivery nozzle 38, and this comprises a shut-off or cut-off position of the nozzle disk 70.

Figure 9:
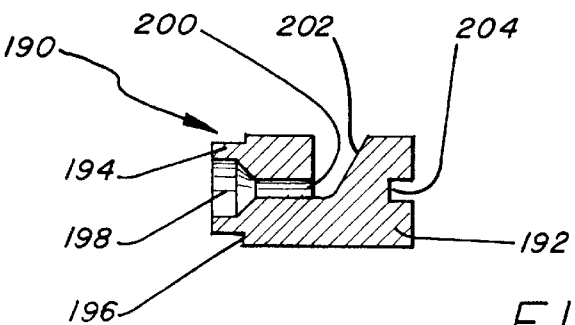
FIG. 9 is a view in partial section of a portion of the apparatus of the present invention.
Figure 10:
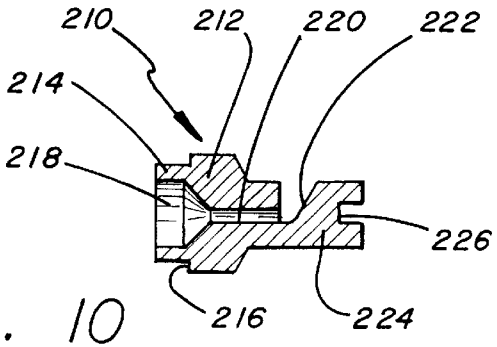
FIG. 10 is a view in partial section of an alternate embodiment of the apparatus of FIG. 9.

A pair of nozzle tips 190 and 210 are shown in FIG. 3, and the tips 190 and 210 are shown in partial section in FIGS. 9 and 10, respectively. The tips 190 and 210 are substantially identical in general configuration. They differ from each other in their size. The tip 190 is substantially larger than the tip 210 and it quantitatively puts out more spray than does the tip or nozzle tip 210.

For the following discussion of the tips 190 and 210, reference will be made respectively to FIGS. 9 and 10 and also to FIG. 3.

The nozzle tip 190 includes a front cylindrical portion 192 and a rear cylindrical portion 194. A shoulder 196 extends radially outwardly between the rear cylindrical portion 194 and the front cylindrical portion 192. The diameter of the real cylindrical portion 194 is less than that of the front cylindrical portion 192, and extends into the delivery bore 116. The shoulder 196 is disposed on the front face of the nozzle selector plate 70. The rear face of the cylindrical portion 194 is disposed against the O-ring 118 to appropriately seal the nozzle tip 190 in the counterbore 116.

A bore 198 extends inwardly from the rear face of the rear cylindrical portion 194. The bore 198 extends to a discharge orifice 200. The discharge orifice 200 extends to a discharge face 202.

The size of the bore 198 and size of the discharge orifice 202 determine the fluid quantity which comprises the output of the nozzle tip 190. As indicated above, the size of the delivery bores and counter bores in the nozzle selector plate are all substantially identical. Accordingly, the quantitative variation depends on a particular nozzle tip. Therefore, it is the size of the bore 198, which is aligned with the delivery bore 114, together with the size of the discharge orifice 200, which determine the output of the nozzle tip 190. The fluid flowing through the orifice 200 impinges on the face 202, which comprises a discharge face, and provides a fan shaped spray for the nozzle tip 190.

In the front face of the cylinder 192 is a slot 204. The purpose of the slot 204 is to allow the nozzle tip 190 to be adjusted angularly relative to the nozzle selector plate 70.

The nozzle tip 210 is somewhat smaller in quantitative output than the nozzle tip 190, as mentioned above. The nozzle tip 210 includes a center cylindrical portion 212 and a rear cylindrical portion 214. A shoulder 216 extends radially outwardly between the rear, lesser diameter cylinder portion 214, and the outer diameter of the central cylindrical portion 212. A bore 218 extends through the rear cylindrical portion 214 and extends to a discharge orifice 220. The discharge orifice 220 communicates with a discharge face 222 and a front cylindrical portion 224. Again, the real cylindrical portion 214 extends into a delivery bore in the nozzle selector plate 70. As shown in FIG. 3, the nozzle tip 210 is disposed against the O-ring 88 which in turn is disposed in the counterbore 86 which communicates with the delivery bore 84. The rear cylindrical portion 214 extends into the counterbore 86, with the shoulder 216 disposed on the front face of the nozzle selector plate 70. The rear face of the rear cylindrical portion 214 is disposed against the O-ring 88 to seal the nozzle tip 210 in the counterbore 86.

The front face of the front cylindrical portion 224 includes a slot 226. The slot 226 provides the same function as the slot 204 of the nozzle tip 190, namely to allow the nozzle tip 210 to be angularly adjusted in the counterbore 86.

The bore 218 has a smaller diameter than does the bore 198, and the orifice 220 is smaller than the orifice 200, and accordingly the tip 210 provides a lesser quantitative output than does the tip 190. Again, the orifice 220 extends to and communicates with the discharge face 222 to provide a fan shape for the fluid flowing through the discharge orifice 220.

It will be understood that tips or nozzle tips of various capacities may be inserted into the six counterbores in the nozzle selector plate 70. Accordingly, a crop dusting pilot need only index the nozzle plate 70 to the appropriate nozzle tip in accordance with a desired spray quantity. On the other hand, if desired, several of the same size tips or nozzle tips may also be secured to the nozzle selector plate 70. The nozzle selector plate 70 essentially comprises a selector plate when tips of varying quantities or capacities are secured thereto. The rotation of the nozzle selector plate 70 to align a desired nozzle tip with the delivery port 38 provides a desired quantitative output from the selected nozzle tip.

The tips or nozzle tips are secured to the disk or plate 70 by a central block 170. The central block 170 is shown in FIGS. 1, 2, and 3. For the following discussion of the block 170, reference will be made to FIGS. 1, 2, and 3.

The central block 170 includes a maximum diameter cylindrical portion 172 and a minimum diameter cylindrical portion 178. A shoulder 176 extends between the two cylindrical portion 172 and 178. The cylindrical portion 172 includes a front face 174. The cylindrical portion 178 includes a r ear face 180. An axial bore 182 extends through the block 170.

The overall length of the cylindrical portion 178 is substantially the same as the overall axial length of the nozzle tips affixed to the disk 70. It will be noted that the overall length of the nozzle tips, regardless of their quantity variation, are the same. Moreover, the nozzle tips each include a relatively flat front face. The diameter of the cylindrical portion 178 is such that it fits inside a circle defined by a tangent to the nozzle tips at their inner periphery. This is shown by the dotted line 178 in FIG. 2. The outer diameter of the cylindrical portion 172 is such that it overlaps the front faces of each of the nozzle tips, with the shoulder 176 disposed on the front faces of the tips. This is also best shown in FIG. 2.

The axial bore 182 receives the pin or stud 22, and a washer 26 is disposed about the pin or stud 22 and disposed on the front face 174 of the cylindrical portion 172. A nut 28 then engages the threaded portion 24 to secure the gasket disk 50, the nozzle selector plate 70, and all of the nozzle tips to the base 12. The nozzle tips are, of course, secured to the nozzle selector plate 70, and the plate 70, with its nozzle tips secured thereto, is appropriately secured to the base 12. The other nozzle tips illustrated in FIG. 2 include a nozzle tip 230, a nozzle tip 240, a nozzle tip 250, and a nozzle tip 260. It will be understood that the nozzle tip 260 has a minimum quantitative output capacity, while the nozzle tip 230 has a maximum quantitative output capacity. Nozzle tips 250 and 240 increase in output capacity between nozzle tips 260 and 230, thus providing different output capacities which may be selected by a user.

Figure 12:
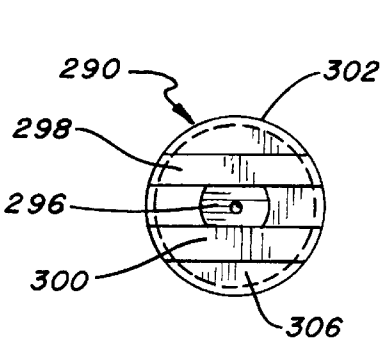
FIG. 12 is a front view of a portion of the apparatus of FIG. 11.
Figure 14:
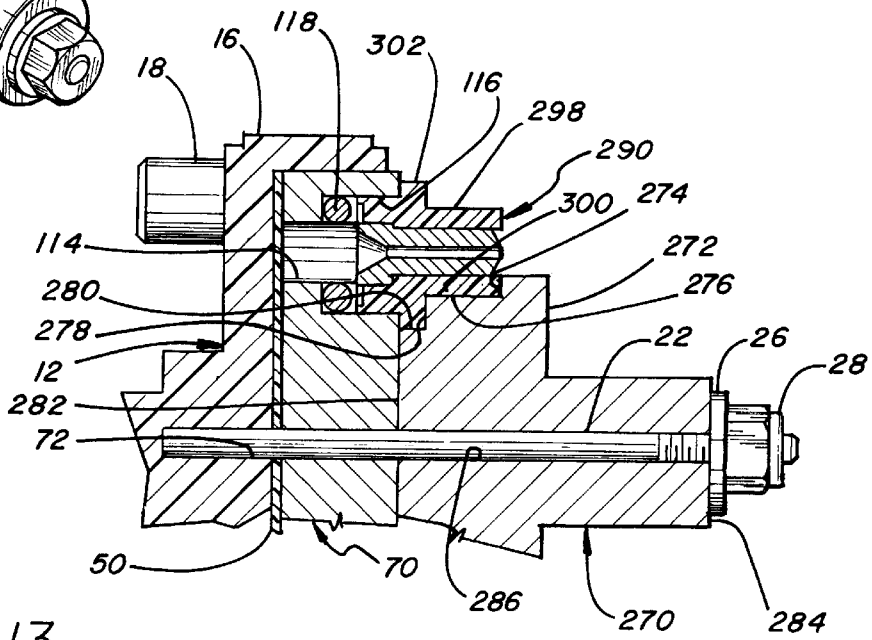
FIG. 14 is a view in partial section taken generally along line 14—14 of FIG. 11.
Figure 11:
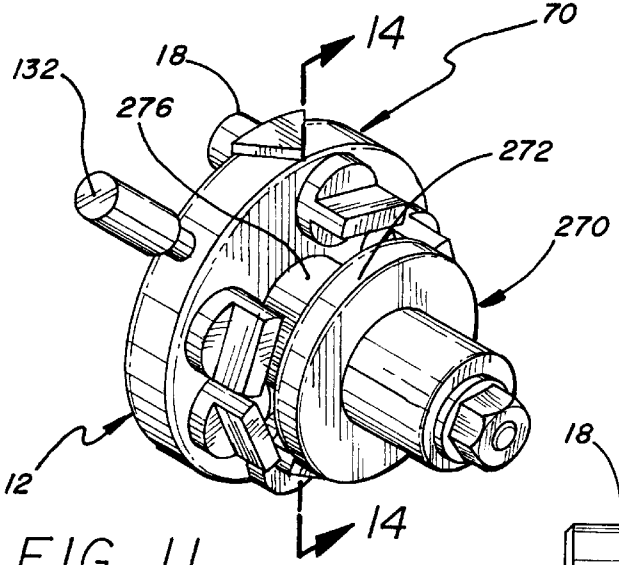
FIG. 11 is a perspective view of a portion of an alternate embodiment of the apparatus of the present invention.
Figure 13:
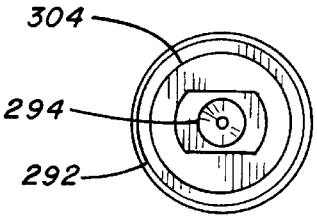
FIG. 13 is a rear view of the apparatus of FIG. 12.

FIG. 11 is a perspective view of an alternate embodiment of the apparatus of the present invention, showing the employment of a different nozzle tip configuration from the flood type nozzle tips discussed above in conjunction with FIGS. 1, 2, 3, 9, and 10, and of an alternate central block 270 used with the alternate nozzle tip. A flat fan nozzle tip 290 is shown in FIG. 11, and FIG. 12 is a front view of the flat fan nozzle tip 290. FIG. 13 is a rear view of the nozzle tip 290. FIG. 14 is a view in partial section taken generally along line 14—14 of FIG. 11, showing the alternate embodiment central block 270 and the tip 290. For the following discussion, reference will primarily be made to FIGS. 11, 12, 13, and 14.

The base 12 is shown, with the sealing disk or gasket 50 disposed between the base 12 and the nozzle selector plate 70. In the counterbore 116 is the O-ring 118 and the straight nozzle tip 290.

The nozzle tip 290 includes a rear face 292 which is disposed against the o-ring 118 in the counterbore 116. The nozzle tip 290 also includes a delivery bore 294 which extends from die rear face 292 to a delivery slot 296. The nozzle tip 290 also includes a pair of walls 298 and 300 which are generally parallel to each other and spaced apart. The walls 298 and 300 are also parallel to the delivery slot 296. The slot 296 is centered between the walls 298 and 300.

There is a front cylindrical portion 302 and a rear cylindrical portion 304 on the nozzle tip 290. The rear cylindrical portion 304 extends into the counterbore 116 in the nozzle selector plate 70. The nozzle tip 290 also includes a front face 306.

The central block 270 includes a maximum diameter cylindrical portion 272 and an intermediate diameter cylindrical portion 276. A shoulder 274 extends between the portions 272 and 276. The block 270 also includes a minimum diameter cylindrical portion 280, and a shoulder 278 extends between the portions 276 and 280.

The minimum diameter portion 280 includes a rear face 282 which is disposed against the front face 138 of the disk 70. The minimum diameter portion 278 receives the cylindrical portion 304 of the nozzle 290. The face 306 of the nozzle 290 is disposed against the shoulder 278. The wall 300 is shown disposed against the intermediate diameter portion and against the shoulder 274 in FIG. 14.

A central bore 286 extends through the block 270 and receives the pin 22 to secure the block 270 and nozzle tips, such as the tip 290, to the base 12. The washer 26 and nut 28 are used to secure the assembly together.

Figure 16:
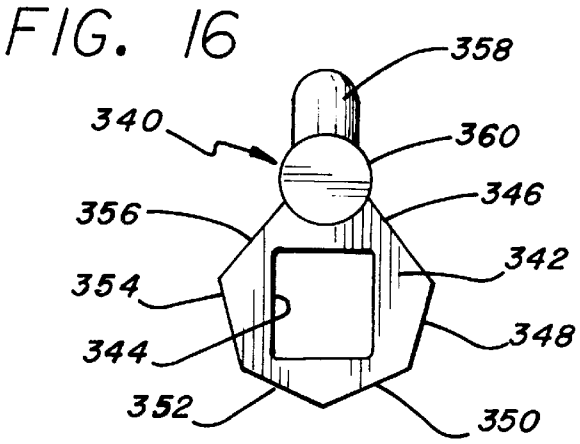
FIG. 16 is a front plan view of a portion of the apparatus of FIG. 15.
Figure 17:
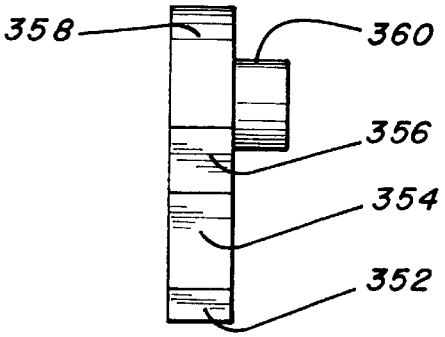
FIG. 17 is a side view of the apparatus of FIG. 16.
Figure 15:
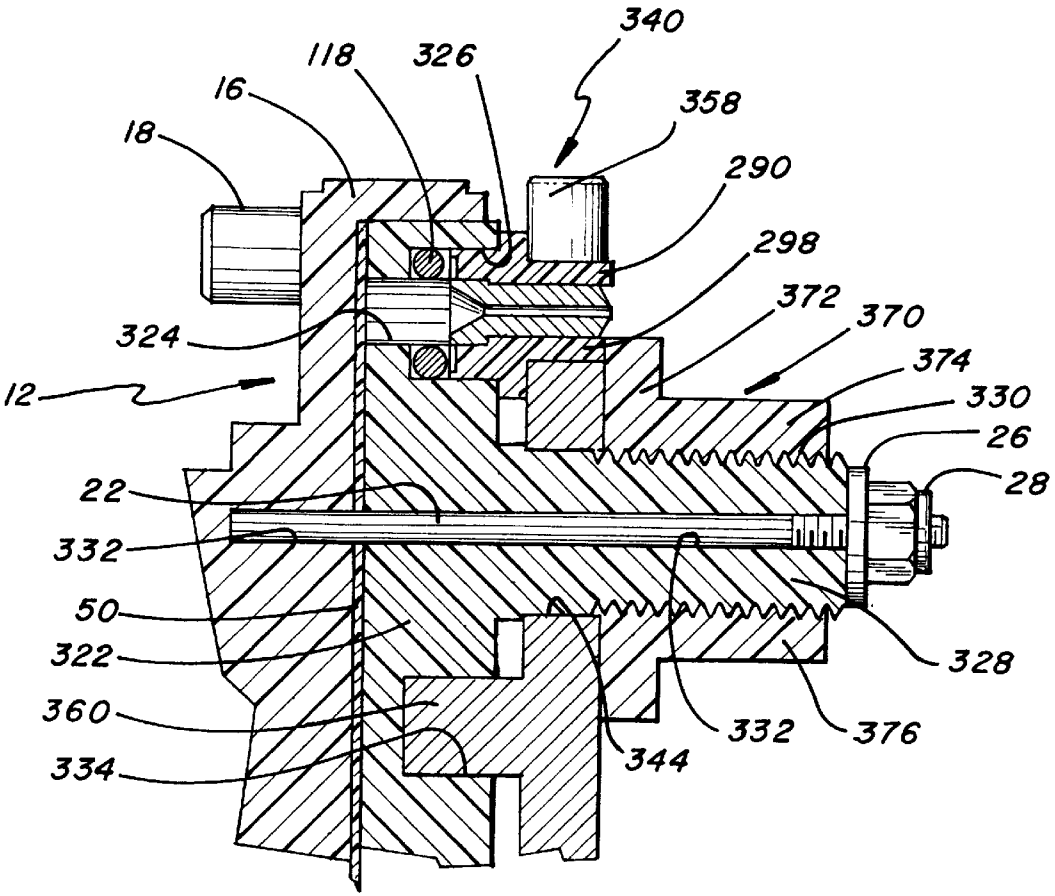
FIG. 15 is a fragmentary view in partial section of an alternate embodiment of a portion of the apparatus of the present invention.

FIG. 15 is a fragmentary view in partial section of an alternate embodiment nozzle selector plate 320 and associated elements. The base 12 is again shown, with the sealing disk or gasket 50 disposed between the base 12 and the nozzle selector plate 320. FIG. 16 is a front plan view of a wrench element 340 used with the selector plate 320, and FIG. 17 is a side view of the wrench 340. For the following discussion, reference will primarily be made to FIGS. 15, 16, and 17.

The nozzle selector plate 320 includes a cylindrical base portion 322 which fits into the base 12 against the gasket 50 within the rim 16. The plate 320 includes a plurality of delivery bores 324 with their counterbores 326, spaced apart form each other, substantially identical to the bores and counterbores in the selector plate 70. An O-ring 118 is disposed in each counterbore 326 to seal the nozzle tips disposed therein, such as the flat fan tip 290 shown in FIG. 15 disposed in the counterbore 326.

The selector plate 320 also includes a central boss 328 which includes an outer threaded portion 330. Extending through the plate 320 and the boss 328 is a central bore 332 which receives the pin 22 for securing the plate 320 to the base 12. The washer 26 and the nut 28 are used to secure the selector plate 320 to the base 12 by the pin 22.

In place of a seventh delivery bore and counterbore, there is a wrench bore which cooperates with a wrench 340 which is used to rotate the selector plate 320 to index a particular nozzle tip with the delivery point 38 (see FIG. 2) in the base 12. The wrench bore 334 does not extend through the base, thus still providing a cutoff or no flow position for the selector plate 320 against the base 12.

Note that the diameter of the threaded portion 330 is greater than the outer diameter of the washer 26 and the nut 28. This allows for the use of a nut 370 to secure the nozzle tips on the plate 320. The nut 370 will be discussed below.

The wrench 340 includes a wrench body 342 and a central opening 344 extends through the body 342 and receives the boss 328 of the plate 320. Disposed on the outer periphery of the body 342 are six wrench flats 346, 348, 350, 352, 254, and 356. In place of a seventh flat is a handle 358. At the juncture of the handle 358 and the body 342 is an outwardly extending boss 360. The boss 360 extends into the wrench bore 334 to rotate the plate 320 to align the desired tip with the delivery port 38 (see FIG. 2).

The wrench flats 346 . . . 356 are disposed against a wall of the tips, such as may best be understood from FIG. 12. That is, a wrench flat would be disposed against an outer surface of a wall 298 or 300, depending on how the tip was oriented in a counterbore 326. With the pin 360 disposed in the bore 334, moving the handle 358 rotates the selector plate 320 on the pin 22 of the base 12 to align a desired nozzle tip with the delivery port 38.

The nozzle selector plate 320 is locked in place by the nut 370. The nut 370 includes a circular base plate 372, the diameter of which is sufficient to be disposed on the top surface of a wall, such as the wall 298 of the nozzle tip 290 as shown in FIG. 15.

The nut 370 also includes a boss 374 which extends coaxially outwardly from the base plate 372. Extending through the plate 372 and the boss 374 is a central bore, a portion 376 of which is internally threaded to matingly engage the external threads 330 on the boss 328 of the selector plate 320. The threaded engagement secures the wrench 340 and the nozzle tips to the selector plate 320. For rotating the selector plate and the nozzle tips secured thereto, a user need only loosen the nut 370 and move the wrench 340 by means of the handle 358 to align a desired tip with the delivery port 38 (see FIG. 2). This assumes, of course, that the nut 28 is not tightened excessively, but is only tightened sufficiently to secure the selector plate 320 to the base 12 but will still allow the plate 320 to rotate in the base 12 in response to movement of the wrench 340.

Different types of nozzle tips may be used with the apparatus of the present invention depending on the liquid spray pattern desired. Moreover, the nozzle apparatus may be connected to any fluid flow source, although a quick disconnect unit and associated elements are illustrated.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Multiple nozzle spray apparatus comprising in combination:

base means securable to a fluid flow, including a delivery port through which the fluid flows;

nozzle selector plate means rotatably secured to the base means, including a plurality of nozzle tips, each of which is selectably aligned with delivery port for providing a spray of the fluid, a wrench bore, and a wrench having a pin extending into the wrench bore for rotating the nozzle selector plate means to alien a nozzle tip with the delivery port; and means for securing the nozzle selector plate means to the base means.

2. The apparatus of claim 1 in which the base means includes a back wall and a rim extending outwardly circumferentially from the back wall, and the delivery port extends through the back wall.

3. The apparatus of claim 2 in which the base means further includes a pin extending outwardly from the back wall and through the nozzle selector plate, and the means for securing the nozzle selector plate means to the base means is secured to the pin.

4. The apparatus of claim 3 in which the nozzle selector plate means is at least partially disposed within the rim of the base means.

5. The apparatus of claim 4 in which the nozzle selector plate includes a plurality of bores communicating with the plurality of nozzle tips, and each bore is selectively alignable with the delivery port of the base means.

6. Multiple nozzle spray apparatus comprising in combination: base means securable to a fluid flow, including a back wall, and a delivery port extending through the back wall through which the fluid flows;

nozzle selector plate means securable to the base means, including

A plurality of bores selectively alignable with the delivery port, a wrench bore, and a plurality of nozzle tips disposed in the plurality of bores for spraying the fluid;

means for securing the nozzle selector plate means to the base means; and means for rotating the nozzle selector plate means relative to the base means for selectively aligning a nozzle tip with the delivery port including a wrench having a handle and a pin extending into the wrench bore.

7. The apparatus of claim 6 in which the nozzle selector plate means further includes a plurality of counterbores in the plurality of bores for receiving the nozzle tips.

8. The apparatus of claim 6 in which the means for securing the nozzle selector plate means to the base means includes a pin secured to the base means and extending through the nozzle selector plate means.

9. The apparatus of claim 8 in which the nozzle selector plate means further includes a boss, and the pin extends through the bossy and a first nut is threadedly secured to the pill.

10. The apparatus of claim 9 which further includes a second nut threadedly disposed on the boss and against the nozzle tips, and loosening the second nut allows the nozzle selector plate means to be rotated on the base means.

11. Spray apparatus comprising in combination:

base means securable to a flow of fluid, including a delivery port through which the fluid flows;

nozzle selector plate means rotatable on the base means for aligning a nozzle tip with the delivery port, including a nozzle selector plate, a plurality of nozzle tips in the nozzle selector plate for spraying the fluid secured to the nozzle selector plate, and a wrench bore extending into the nozzle selector plate;

wrench means for rotating the nozzle selector plate to align a nozzle tip with the delivery bore, including a pin extending into the wrench bore for securing the wrench to the selector plate to rotate the selector plate; and means for securing the nozzle selector plate means to the base means.

12. The apparatus of claim 11 in which the base means further includes a pin extending through the nozzle selector plate means and the nozzle selector plate means rotates on the pin.

13. The apparatus of claim 12 in which the nozzle selector plate means further includes a boss through which the pin extends.

14. The apparatus of claim 13 in which the wrench means further includes an opening through which the boss extends.

15. The apparatus of claim 14 in which the wrench means further includes a body disposed against the plurality of nozzle tips and a handle extending from the body for rotating the selector plate.

16. The apparatus of claim 14 in which the nozzle selector plate means further includes a threaded portion on the boss and a nut disposed against the plurality of nozzle tips and on the threaded portion of the boss for securing the nozzle tips to the selector plate.

17. The apparatus of claim 16 in which the means for securing the nozzle selector plate means to the base means includes a nut secured to the pin of the base means.

* * * * *